US008779906B2

(12) United States Patent
Manning

(10) Patent No.: US 8,779,906 B2
(45) Date of Patent: Jul. 15, 2014

(54) PERSONAL SAFETY AND ALARM SYSTEM

(76) Inventor: Robert Douglas Manning, Prairie Grove, AR (US)

( * ) Notice: Subject to any disclaimer, the term of this patent is extended or adjusted under 35 U.S.C. 154(b) by 29 days.

(21) Appl. No.: 13/426,009

(22) Filed: Mar. 21, 2012

(65) Prior Publication Data

US 2012/0299711 A1 Nov. 29, 2012

Related U.S. Application Data

(60) Provisional application No. 61/519,448, filed on May 23, 2011.

(51) Int. Cl.

| | |
|---|---|
| ***G08B 23/00*** | (2006.01) |
| ***G08B 15/02*** | (2006.01) |
| ***G08B 15/00*** | (2006.01) |

(52) U.S. Cl.

CPC ..... *G08B 15/02* (2013.01); *G08B 15/00* (2013.01)

USPC ..... 340/321; 340/326; 340/691.5; 340/693.9

(58) Field of Classification Search

USPC ..... 340/691.1, 691.4, 691.5, 692, 693.5, 340/693.9, 574, 321, 326, 331, 541, 545.1, 340/539.1, 539.11, 539.14

See application file for complete search history.

(56) References Cited

U.S. PATENT DOCUMENTS

| | | | | |
|---|---|---|---|---|
| 4,716,402 | A * | 12/1987 | Francis | 340/546 |
| 5,127,615 | A * | 7/1992 | Jones | 248/172 |
| 5,604,483 | A * | 2/1997 | Giangardella et al. | 340/565 |
| 5,644,297 | A * | 7/1997 | Masi et al. | 340/573.1 |
| 5,859,588 | A * | 1/1999 | Malone et al. | 340/574 |
| 6,124,796 | A * | 9/2000 | Hincher | 340/628 |
| 7,650,948 | B2 * | 1/2010 | Rousseau et al. | 169/51 |
| 8,177,065 | B1 * | 5/2012 | Thomas | 206/376 |
| 2006/0186129 | A1 * | 8/2006 | Allnutt et al. | 220/737 |
| 2008/0001743 | A1 * | 1/2008 | Gallagher | 340/571 |

* cited by examiner

*Primary Examiner* — Thomas Mullen

(74) *Attorney, Agent, or Firm* — Dennis L. Thomte; Thomte Patent Law Office LLC

(57) ABSTRACT

A personal safety and alarm system including a siren/strobe light, and a pepper spray container which are selectively removably positioned in a holder with the holder being selectively detachably secured to a stand for use on a bedside table or the like or which may be placed in the person's purse or pocket. The system also includes a flashlight which is selectively removably secured to the stand.

3 Claims, 3 Drawing Sheets

PERSONAL SAFETY AND ALARM SYSTEM

CROSS-REFERENCE TO RELATED APPLICATION

This application claims the benefit of Provisional Application Ser. No. 61/519,448, filed on May 23, 2011, entitled PERSONAL SAFETY AND ALARM SYSTEM.

BACKGROUND OF THE INVENTION

1. Field of the Invention

This invention relates to a personal safety and alarm system and more particularly to a personal safety and alarm system including a siren/strobe light, and a pepper spray container which are selectively removably positioned in a holder with the holder being selectively detachably secured to a stand for use on a bedside table or the like or which may be removed from the stand and placed in a person's purse or pocket. Even more particularly, the system includes a flashlight which is selectively removably secured to the stand.

2. Description of the Related Art

Many types of personal safety and alarm systems have been previously provided. For example, pepper spray containers and mace containers are frequently carried in a person's purse or pocket to ward off an attacker. In some cases, the pepper spray container or the mace container is also placed on a bedside table or the like should the person be attacked or should the person be subjected to an intruder who enters the person's residence. Audio alarms are also provided on keychains or the like to enable a person, who is moving from a vehicle to a store or vice versa, to activate the alarm if the person is subjected to an attacker.

Further, to the best of Applicant's knowledge, no one has previously provided a personal safety and alarm system wherein the components thereof may be selectively removably secured to a stand with the stand being positioned on a bedside table or the like or provide a personal safety and alarm system which can be conveniently carried as a unit in a person's pocket or purse.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A personal safety and alarm system is disclosed comprising a stand means having a generally horizontally disposed base for selectively removable placement on a supporting surface such as a bedside table or the like, and an upstanding support member extending upwardly from the base. The support member has a front side and a back side. A first flashlight is selectively removably positioned at the front side of the support member. A generally rectangular-shaped holder, having a front wall, a back wall, a bottom wall, opposite side walls and an open upper end is also provided. The holder is selectively removably secured to the support member at the front side thereof. A pepper spray container or the like is selectively removably positioned in the holder. A siren means is also selectively removably positioned in the holder. The selectively removable attachment of the holder to the support member permits the holder, with the siren and the pepper spray container to be removed from the stand and placed in a person's pocket or purse.

In the preferred embodiment, the siren means also includes a strobe light. In the preferred embodiment, the siren means includes a speaker with the support member having an opening formed therein which is positioned rearwardly of the speaker of the siren means whereby the siren means will direct siren sounds rearwardly through the opening in the support member when the siren means is in the holder and the siren means is activated.

In the preferred embodiment, the support member glows in the dark. Also, in the preferred embodiment, an envelope means is attached to the backside of the support member for containing photos and information relating to the owner of the system.

It is therefore a principal object of the invention to provide an improved personal safety and alarm system.

A further object of the invention is to provide a personal safety and alarm system which may be either selectively removably mounted on a stand or which may be removed therefrom for placement in a person's pocket or purse.

A further object of the invention is to provide a system of the type described which includes a spray container, siren/strobe light means and flashlight.

A further object of the invention is to provide a personal safety and alarm system of the type described including a stand means having a holder selectively detachably secured thereto with the holder containing a pepper spray container and a siren/strobe light means so that the holder with the siren/strobe light means and pepper spray container may be removed from the stand and placed in a person's purse or pocket.

A further object of the invention is to provide a personal safety and alarm system of the type described wherein the stand thereof glows in the dark to enable a person to readily locate the same.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
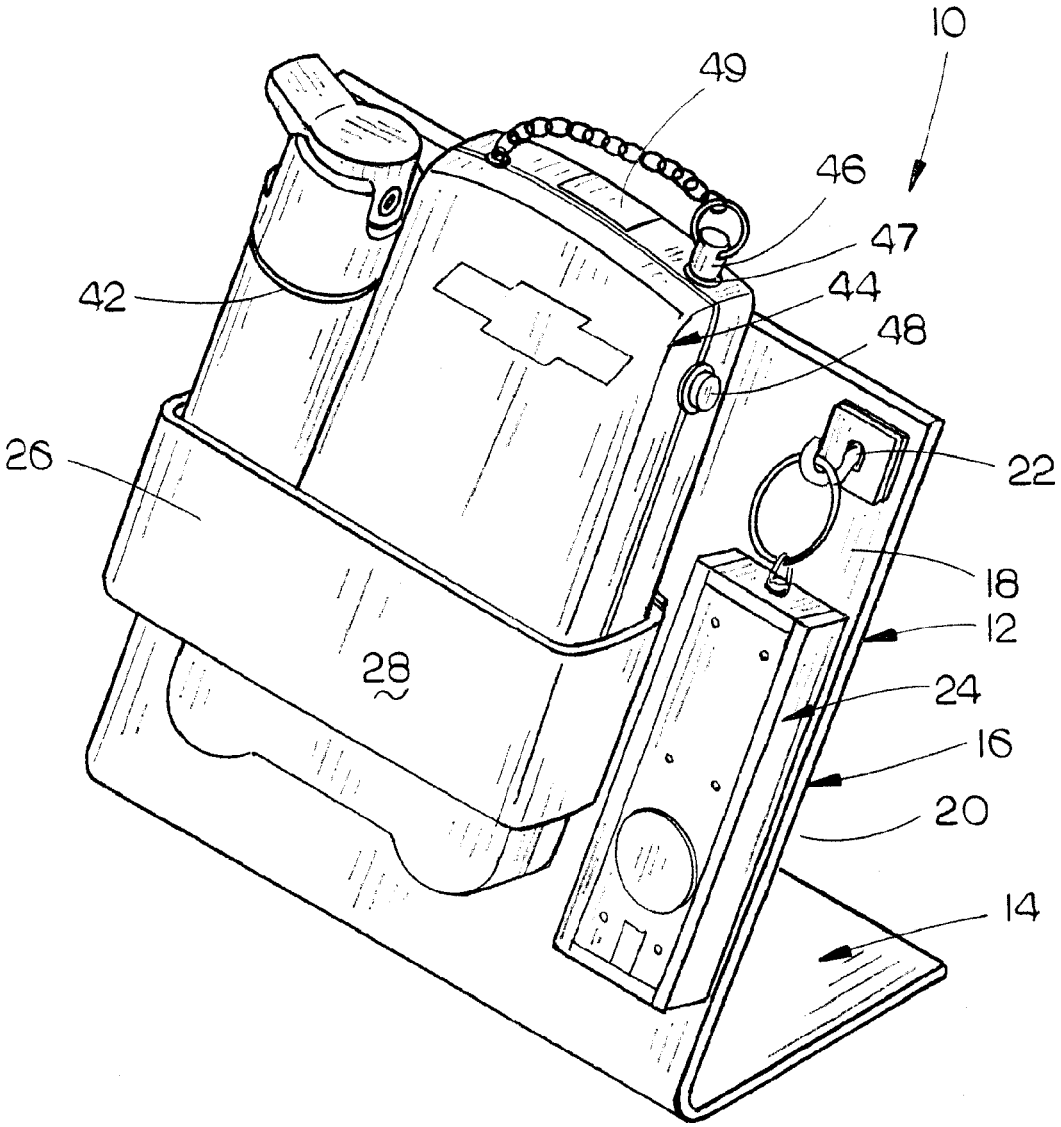
FIG. 1 is a front perspective view of the personal safety and alarm system of this invention wherein the siren, spray container and flashlight are selectively removably secured to a stand.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The personal safety and alarm system of this invention is referred to generally by the reference numeral 10. The system 10 includes a stand 12 which includes a base portion 14 and an upstanding support member 16 which extends upwardly and rearwardly from the forward end of the base 14. For purposes of description, support member 16 will be described as having a front side 18 and a back side 20.

The numeral 22 refers to a hook which is secured to the front side 18 of the support member 16 at the upper right hand corner thereof, as seen in FIG. 1. The numeral 24 refers to a conventional battery powered flashlight which is selectively detachably secured to the hook 22, as seen in FIG. 1.

The numeral 26 refers to a generally rectangular-shaped holder which includes a front wall 28, back wall 30, opposite side walls 32 and 34, a closed lower end 36 and an open upper end 38.

Figure 2:
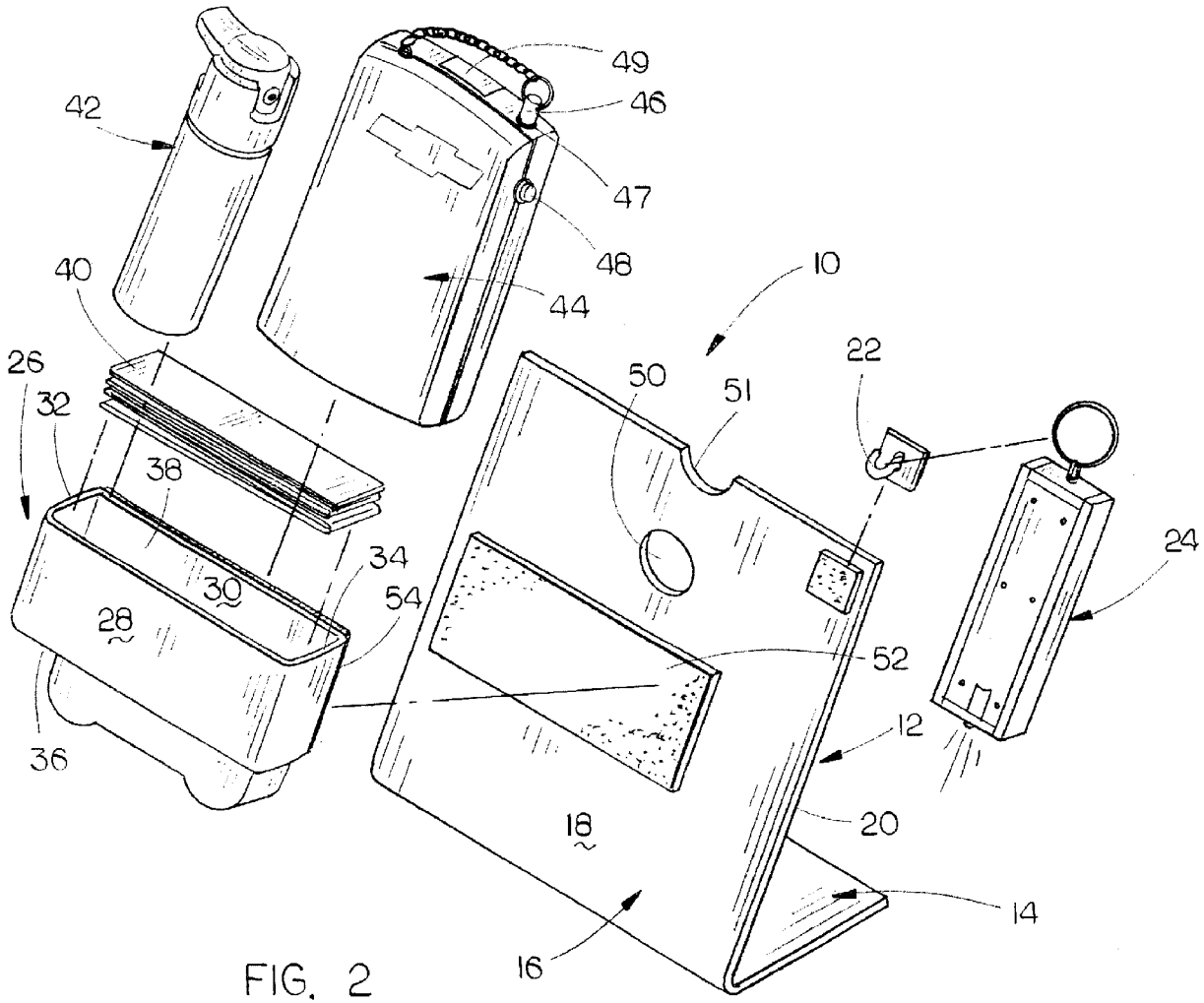
FIG. 2 is an exploded perspective view of the system of FIG. 1.

As seen in FIG. 2, holder 26 is adapted to receive a folded sheet or sheets 40 which may contain information regarding the person owning the system 10. The numeral 42 refers to a spray container which is preferably a pepper spray container.

The numeral 44 refers to a conventional battery powered siren means which is activated when the pin 46 is removed from socket 47. The siren 44 also includes a combination strobe light/flashlight with the light emitting light from the front and top of the siren 44. Switch 48 is provided at one side of the siren 44. When the switch is moved to the "on" position, the circuit for the flashlight portion of 49 is activated. When the pin 46 is removed from socket 47, the strobe light portion of 49 is illuminated. Support member 16 includes an opening 50 formed therein which registers with the speaker of the siren 44, when the siren means 44 is positioned in the holder 26, so that the sound of the siren will pass therethrough when the siren is activated. Support member 16 also includes a semi-circular cut-out or opening 51 through which the strobe light portion of 49 will direct light when the siren means 44 is positioned in the holder 26.

The front side 18 of support member 16 has one half of a VELCRO® strip 52. Holder 26 has the other half of the VELCRO® system at its backside thereof which is referred to by the reference numeral 54.

Thus, the holder 26 may be selectively detachably secured to the support member 16 by the meshing of the VELCRO® strips 52 and 54.

If the system is mounted on the stand 12 as illustrated in FIG. 1, the stand may be placed on a bedside table or the like. Should the owner of the system sense that there is an intrusion or an attacker in the dwelling, the person will be able to readily determine the location of the system since the stand 12 is comprised of a material which will glow in the dark.

If the person owning the system desires to use a portion of the system, other than on the bedside table or the like, the holder 26 may be selectively removed from the stand 12 and placed in a person's pocket or purse with the components 42 and 44 maintained in the holder 26.

Figure 3:
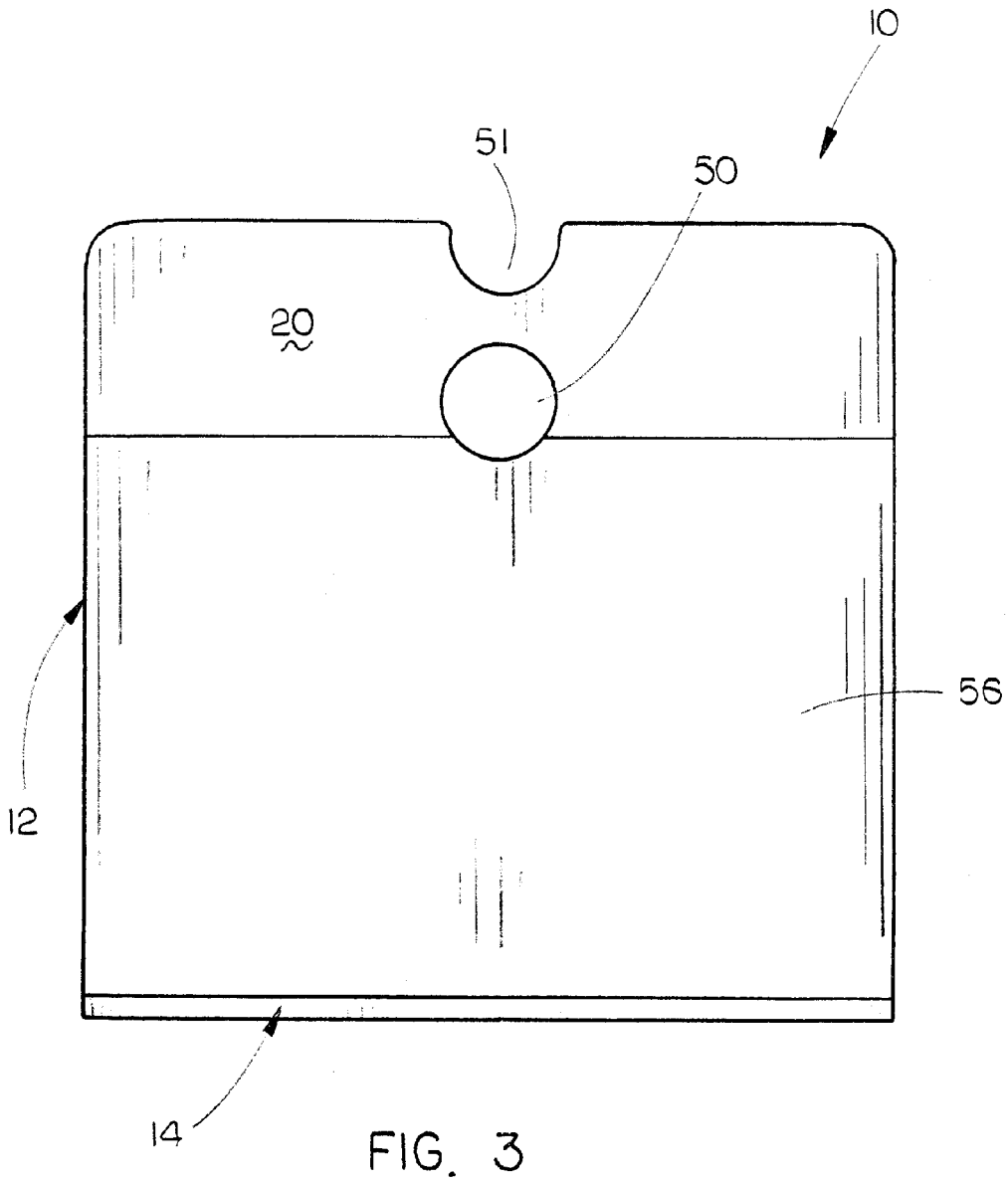
FIG. 3 is a back view of the stand of FIG. 1.

FIG. 3 illustrates an optional feature for the system. An open upper ended envelope 56 is detachably secured to the backside of the stand 16 and may contain personal information about the owner of the system to enable authorities to ascertain the person's identity, etc. Envelope 56 may also contain photos of the owner.

Thus it can be seen that the system of this invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A stand means for supporting safety and alarm devices, comprising:

a horizontally disposed base having a front edge, a rear edge, opposite side edges, a lower surface and an upper surface for selective placement on a supporting surface;

an upstanding support member extending upwardly and rearwardly from said front edge of said base;

said upstanding support member having a lower end, an upper end, a first side edge, a second side edge, a front side and a back side;

a generally rectangular-shaped holder having a front wall, a back wall, a bottom wall, opposite side walls, and an open upper end;

said back wall of said holder being selectively removably secured to said front side of said upstanding support member;

said holder being configured to selectively removably receive a spray container and a siren therein;

said upstanding support member having a hook member secured thereto adjacent said first side edge thereof at said upper end of said upstanding support member;

said back side configured to have an envelope selectively removably attached thereto.

2. The stand means of claim 1 wherein said base and said upstanding support member are comprised of a glow-in-the-dark material.

3. The stand means of claim 1 wherein said upstanding support member has an opening formed therein above said holder.

* * * * *